United States Patent [19]

Newby

[11] Patent Number: 4,755,263

[45] Date of Patent: Jul. 5, 1988

[54] PROCESS OF ELECTROPLATING AN ADHERENT CHROMIUM ELECTRODEPOSIT ON A CHROMIUM SUBSTRATE

[75] Inventor: Kenneth R. Newby, Berkeley Heights, N.J.

[73] Assignee: M&T Chemicals Inc., Woodbridge, N.J.

[21] Appl. No.: 908,434

[22] Filed: Sep. 17, 1986

[51] Int. Cl.[4] ..... C25D 5/34; C25D 3/04

[52] U.S. Cl. ..... 204/29; 204/32.1; 204/51

[58] Field of Search ..... 204/51, 32.1, 29

[56] References Cited

U.S. PATENT DOCUMENTS

| | | | |
|---|---|---|---|
| 1,942,356 | 1/1934 | Fink | 204/51 |
| 3,699,013 | 10/1972 | Miyata et al. | 204/32.1 |
| 4,412,892 | 11/1983 | Chen et al. | 204/32.1 |
| 4,416,738 | 11/1983 | Herrmann, Jr. | 204/32.1 |
| 4,472,249 | 9/1984 | Chessin | 204/51 |
| 4,501,647 | 2/1985 | Korpi et al. | 204/23 |
| 4,525,250 | 6/1985 | Fahrmbacher-Lutz et al. | 204/58.5 |
| 4,585,530 | 4/1986 | McMullen et al. | 204/34 |
| 4,588,481 | 5/1986 | Chessin | 204/51 |

*Primary Examiner*—John F. Niebling
*Assistant Examiner*—Ben C. Hsing
*Attorney, Agent, or Firm*—S. A. Marcus; S. H. Parker; R. E. Birght

[57] ABSTRACT

What is described herein is a method of electroplating an adherent chromium deposit on a chromium substrate. The process is characterized by chemically oxidizing the chromium substrate before starting the electrodeposition of chromium thereon. A suitable chemical oxidizing agent is hydrogen ion, which can be furnished by a dilute acid solution. The invention is applicable to any chromium electroplating bath, including high energy efficient chromium baths, such as HEEF-40 baths, which are presently in commercial use.

8 Claims, No Drawings

PROCESS OF ELECTROPLATING AN ADHERENT CHROMIUM ELECTRODEPOSIT ON A CHROMIUM SUBSTRATE

BACKGROUND OF THE INVENTION

1. Field of the Invention

This invention relates to electroplating of chromium, and, more particularly, it is concerned with an improved process of forming an adherent chromium electrodeposit on a chromium substrate.

2. Description of the Prior Art

Normally, electrodeposited chromium does not adhere well to a chromium underlayer, and for this reason electrolysis must not be interrupted during the plating process. If the article needs to be removed from the solution for any reason, the plating process must be restarted in a special way. Fink, in U.S. Pat. No. 1,942,356, describes the only known method of obtaining an adherent chromium electrodeposit on such a chromium substrate. The method disclosed by Fink comprises warming the chromium part to the bath temperature and then applying voltage slowly until the plating current is reached. Subsequently, Weiner and Walmsley included a mild anodic electrochemical etching step in the Fink process, as described in *Chromium Plating,* Finishing Publications Ltd., Teddington, England (1980) p. 147–8.

The Fink process works well for the conventional sulfate, or a mixed catalyst chromium electroplating bath, and for the 25% efficiency bath described by Chessin and Newby in U.S. No. 4,588,481.

Unfortunately, however, it is not satisfactory for the high energy efficiency (HEEF) baths such as described by Chessin in U.S. Pat. No. 4,472,249, where the efficiency is 40% or higher.

Accordingly, an object of the present invention is to provide an improved process of electro-depositing adherent chromium onto a chromium substrate.

Another object herein is to provide such a process which can be used with the HEEF-40% efficiency chromium baths.

Still another object is to provide a method which can be applied after an interruption in the plating chromium process.

SUMMARY OF INVENTION

What is described herein is a method of electroplating an adherent chromium deposit on a chromium substrate. The process comprises chemically oxidizing the chromium substrate before starting the electrodeposition. A suitable oxidizing agent is hydrogen ion, which can be furnished by a dilute acid solution. The invention is applicable to any chromium electroplating bath, including the HEEF-40% efficient baths.

DETAILED DESCRIPTION OF THE INVENTION

The present invention can be understood most clearly by comparison with the prior art method, as described below. Accordingly, in the prior art method of Weiner and Walmsley, the chromium substrate is treated after a electroplating process has been interrupted and where less than the desired amount of chromium deposit has been formed. The process steps of the prior art, and what happens during each such process step, are summarized below in Table I.

TABLE I

PRIOR ART

| Step | What Happens During Process Step |
|---|---|
| (1) Electrochemically etch chromium substrate in plating bath. | $Cr \rightarrow Cr^3$ (no film formation) |
| (2) Plating is initiated at less than the Cr deposition voltage. | $2H^+ \rightarrow H_2$; $Cr^{+6} \rightarrow Cr^{+3}$, (the $Cr^{+3}$ may form a film) |
| (3) Voltage is raised to allow full plating current. Continue chromium electroplating. | Adherent Cr is deposited from conventional, mixed catalyst and HEEF-25% Cr baths only. (does not work for HEEF-40% baths of U.S. Pat. No. 4,472,249) |

In the present invention, the oxide film on the chromium substrate, if present, is removed, chemically or electrolytically, and the substrate is chemically oxidized, preferably by hydrogen ion, whereupon a film is formed which is substantially free of $Cr^{+6}$. There is no requirement herein for the slow application of voltage, although it may be used. The present method is usable with all known hexavalent chrome baths, including the commercial HEEF-40% baths based on U.S. Pat. No. 4,472,249.

TABLE II

PRESENT INVENTION

| Process Step | What Happens During Process Step |
|---|---|
| (1) Remove oxide film on chromium substrate and initiate chemical oxidation in acid as evidenced by $H_2$ evolution. (if necessary, briefly apply cathodic current to initiate $H_2$ evolution film on Cr substrate, e.g. 1 min, at 1 asi). Continue $H_2$ evolution without current for about 2–3 minutes. | $2H^+ \rightarrow H_2$<br>$Cr \rightarrow Cr^{+3}$<br>A gray/green/black film forms on the Cr surface |
| (2) The oxidized part is water rinsed (optional) | Avoids drag-in of chemicals into the plating bath |
| (3) Plating is commenced in any $Cr^{+6}$ bath. | Adherent Cr is deposited (applicable to HEEF-40% baths) |

The invention will be illustrated now with reference to the accompanying examples.

EXAMPLE 1

A chromium substrate having an oxide thereon was placed in a solution of 10% (v/v) $H_2SO_4$ at room temperature and made electrically cathodic, whereupon the oxide film was removed and evolution of $H_2$ commenced. The current was then turned off and $H_2$ evolution was allowed to continue for 1 min. A gray/black film formed on the chromium substrate. The substrate then was removed and rinsed with water. Thereafter the treated substrate was plated with chromium from a commercial M&T Chemicals, Inc. HEEF-40% chromium bath, based on (U.S. Pat. No. 4,472,249, at 5 asi for 15 min. Adhesion of the chromium deposit was excellent.

EXAMPLE 2

The process of Example 1 was repeated using solutions of an inorganic acid; such as 5% HCl, 5% $H_2SO_4$, or 20% $H_2SO_4$; or a carboxylic acid, such as acetic acid; or other organic acids; such as 70% methane sulfonic acid; and excellent adhesion of the chromium deposit on the treated chromium substrate was obtained in each instance.

EXAMPLE 3

The process of Example 1 was repeated using concentrated $H_3BO_3$ at 50° C. for 15 min. with similar excellent results.

EXAMPLE 4

The process of Example 1 was repeated using 10% HCl in place of sulfuric acid, and the step of applying cathodic current was omitted. The HCl removed the oxide film and chemically oxidized the chromium substrate. The adhesion of chrome on chrome was excellent.

EXAMPLE 5

The process of Example 1 was repeated using a chromium substrate which had been plated with chromium several months previously and had a thick oxide coating thereon. This substrate first was made anodic in 100 g/l NaOH solution for 3 minutes at 3asi and water rinsed before following the steps of Example 1. Excellent adhesion of the chromium deposit was obtained.

Similar results were attained when 10% $H_2SO_4$ or 250 g/l $CrO_3$ solution were substituted for the 100 g/l NaOH electrolyte in the first step above.

EXAMPLE 6

The processes of Examples 1–4 were repeated using (a) a conventional chromium plating bath, and (b) a HEEF-25% bath (U.S. Pat. No. 4,588,481), with similar excellent adhesion of chromium on the chromium substrate.

COMPARATIVE TESTS

The following comparative tests showed conditions which did not provide adherent chromium electrodeposits on chromium.

A. The process of Example 1 was repeated using a solution of 10% $H_2SO_4$ and 25 g/l $CrO_3$. No film formed and a non-adherent chromium deposit was obtained.

B. The process of Example 1 was repeated except that the substrate was removed from the solution immediately after the cathodic treatment. A non-adherent chromium deposit was obtained.

C. The chromium substrate was made electrochemically anodic in 10% $H_2SO_4$. No gray/black film formed, and subsequent HEEF-40% plating produced only non-adherent deposits.

While the invention has been described with respect to certain embodiments thereof, it will be understood that changes and modifications may be made which are within the skill of the art. Accordingly, it is intended to be bound only by the following claims, in which:

What is claimed is:

1. In a method of electroplating an adherent chromium deposit on a chromium substrate, from a chromium electroplating bath the step which comprises chemically oxidizing the chromium substrate with hydrogen ion before electrodepositing chromium thereon from a conventional sulfate, mixed catalyst or other high energy efficient chromium electroplating bath, said chemical oxidizing being evidenced by hydrogen evolution and formation of a gray, green-black film on the surface of the chromium substrate.

2. A method according to claim 1 wherein said chemical oxidizing is carried out in a dilute acid solution.

3. A method according to claim 2 wherein said acid is an inorganic or carboxylic acid.

4. A method according to claim 3 wherein said acid is sulfuric acid, hydrochloric acid, phosphoric acid, boric acid, acetic acid, methane sulfonic acid or benzene sulfonic acid.

5. A method according to claim 1 wherein a cathodic current is briefly applied to the chromium substrate before said chemical oxidizing step.

6. A method according to claim 1 wherein said chemical oxidizing step is carried out after an interruption in the chromium plating process and before restarting chromium plating.

7. A method according to claim 1 wherein any oxide film which is present on the chromium substrate is removed chemically or electrolytically before chemically oxidizing the chromium substrate.

8. A method to claim 7 wherein said oxide film is removed anodically in an electrolyte.

* * * * *